United States Patent [19]

Bohnenkamp et al.

[11] 4,393,658

[45] Jul. 19, 1983

[54] EXTRACTION CONDENSING TURBINE

[75] Inventors: Wulf Bohnenkamp, Düsseldorf-Wittlaer; Gerd Hempel, Hamburg, both of Fed. Rep. of Germany

[73] Assignee: Blohm & Voss AG, Hamburg, Fed. Rep. of Germany

[21] Appl. No.: 281,934

[22] Filed: Jul. 10, 1981

Related U.S. Application Data

[63] Continuation-in-part of Ser. No. 83,413, Oct. 10, 1979, abandoned.

[30] Foreign Application Priority Data

Oct. 13, 1978 [DE] Fed. Rep. of Germany ..... 2844681

[51] Int. Cl.[3] ..... F01B 31/08

[52] U.S. Cl. ..... 60/657; 415/144

[58] Field of Search ..... 60/646, 657, 652, 677; 415/35, 144, 145

[56] References Cited

U.S. PATENT DOCUMENTS

| | | | |
|---|---|---|---|
| 1,601,737 | 10/1926 | Johnson | 415/145 |
| 2,451,261 | 10/1948 | Warren et al. | 60/657 |
| 3,291,447 | 12/1966 | Brandon | 415/144 |

*Primary Examiner*—Allen M. Ostrager
*Assistant Examiner*—Stephen F. Husar
*Attorney, Agent, or Firm*—Toren, McGeady and Stanger

[57] ABSTRACT

A steam extraction turbine including a steam extraction section from which steam may be extracted from the turbine for external use prior to the low pressure section of the turbine. In order to avoid overheating of the low pressure section when the amount of extracted steam is high, there is provided a cooling steam stage immediately upstream of the low pressure section through which steam is applied to the low pressure section to prevent overheating. The cooling steam stage includes blades of the rotor and thus permits energy to be extracted from the steam applied to prevent overheating of the low pressure section, the extracted energy being used to drive the turbine thereby increasing turbine efficiency.

6 Claims, 3 Drawing Figures

EXTRACTION CONDENSING TURBINE

This application is a continuation-in-part of copending application Ser. No. 083,413, filed Oct. 10, 1979, of Wulf Bohnenkamp and Gerd Hempel, for EXTRACTION CONDENSING TURBINE, now abandoned.

The present invention relates generally to steam turbines and more particularly to a steam extraction turbine from which steam may be extracted for uses externally of the turbine such as in industrial plants.

Because of rising fuel costs, there has arisen an increasing need for optimum utilization of steam flowing through a turbine. Particularly, in extraction condensing turbines which are used in combined heating and power plants, it becomes necessary that there be a significant reduction in the minimum amount of throughput through the lower pressure section of the turbine in order to enable extraction of steam for heating purposes and in order to reduce the amount of heat loss due to the energy which is exhausted in the condenser.

In turbines where steam extraction occurs upstream of the low pressure section, the amount of steam flowing to the low pressure section will be affected. Thus, it usually is necessary to ensure that overheating of the low pressure section does not occur and that the exhaust temperature of the steam from the low pressure section is not elevated to an unacceptable degree.

In some instances, the extracted steam is applied in a throttled manner to the low pressure section of the turbine to prevent overheating. However, in such a situation, the temperature of the exhaust steam may rise thereby endangering the output stages of the turbine and the condenser. Additionally, the amount of cooling steam which is drawn for preventing overheating of the low pressure section must sometimes be increased and this will inevitably reduce the efficiency of the overall apparatus.

In this connection, it must be understood that the low pressure section of a turbine is normally used in municipal and industrial heating and power plants predominantly for application during electrical peak load service to prevent overload. In some cases, the time of operation of the low pressure section of a turbine may only be about ten percent of the total time of operation of the turboset. That is, during ninety percent of the total time of operation of the turbine, only a sufficient quantity of steam to avoid overheating need be admitted to the low pressure section of the turbine.

One known possibility for lowering exhaust steam temperature and for thus lowering the amount of cooling steam required involves the injection of condensate into the rotor chamber of the low pressure turbine. However, in such a case there arises the danger that erosion or wear of the rotor blades of the low pressure section may occur in situations of overdosing or of poor evaporation. Additionally, a danger arises in that the external casing or, in a dual-casing construction, the internal casing, will be cooled unilaterally and thereby induce thermal distortion which will give rise to obvious dangers.

Accordingly, the present invention is directed toward a steam extraction turbine which provides effective cooling of the low pressure section to avoid overheating thereof despite the fact that maximum steam may be extracted from an extraction steam chamber upstream of the low pressure section thereby depriving the low pressure section of adequate cooling steam. The invention is particularly directed toward a device which protects the low pressure section from overheating without reducing the overall efficiency of the turbine.

SUMMARY OF THE INVENTION

Briefly, the present invention may be described as a steam extraction turbine comprising a high pressure turbine section, a low pressure turbine section from which steam is exhausted from the turbine, and a steam extraction section arranged in the steam flow path intermediate the high and low pressure sections of the turbine from which steam may be extracted for use externally of the turbine. Valve means are provided between the steam extraction section and the low pressure section for controlling the amount of steam flowing into the low pressure section thereby to control the amount of extraction steam available. In accordance with the invention, cooling means are provided between the steam extraction section and the low pressure section in a flow path which is in parallel with the flow path of the valve means for supplying steam to prevent overheating of the low pressure section. The cooling means include energy extraction means such as blades of the rotor of the turbine operating to extract from the steam flowing through the cooling means energy which may be applied to drive the turbine.

In accordance with the more detailed features of the invention, nozzle means may be provided in the cooling means upstream of the rotor blades of the energy extraction means and the steam extraction section is sealed from the low pressure section of the turbine by an appropriate stuffing box.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
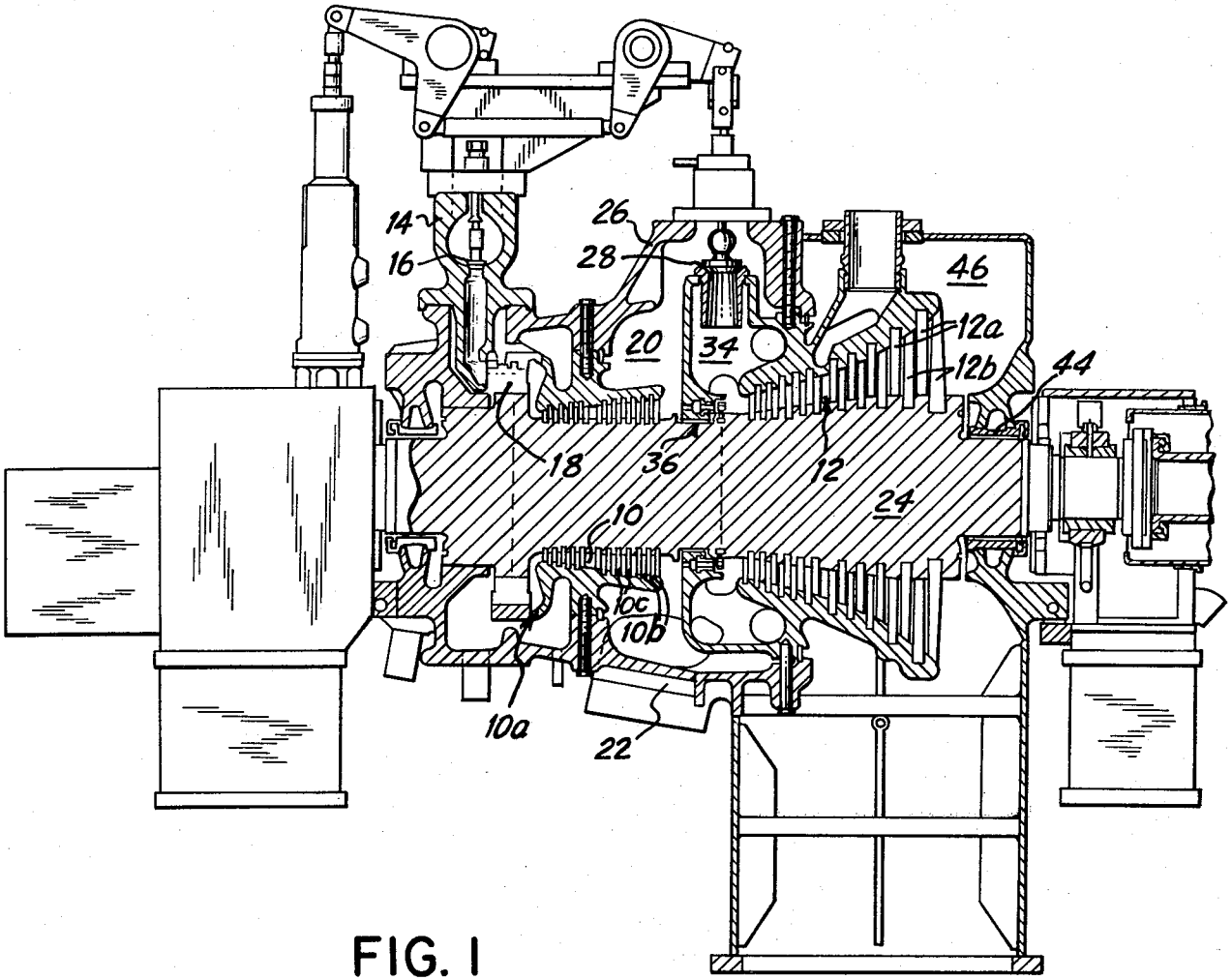
FIG. 1 is a sectional view partially schematic of an overall turbine mechanism within which the present invention is embodied.

Referring now to the drawings, wherein similar reference numerals are used to identify similar parts throughout the figures thereof, and referring first to FIG. 1, a turbine mechanism embodying the present invention is shown which comprises a high pressure section 10 and a low pressure section 12. Steam is admitted into the high pressure section 10 from a steam intake member 14 through a control valve 16 and through a control section 18. The energy of the live steam is converted in a conventional manner by expansion into kinetic energy by passage through the blading of the control section 18 and the high pressure section 10.

The steam expanded to an extraction pressure flows from the blading of the high pressure section 10 into an extraction steam section which includes an extraction steam chamber 20. Depending upon the requirements of the extraction steam system, a portion of the steam is removed from the extraction steam chamber 20 through extraction steam nozzles 22.

10*a* is a wheel chamber of the high pressure section.

Figure 2:
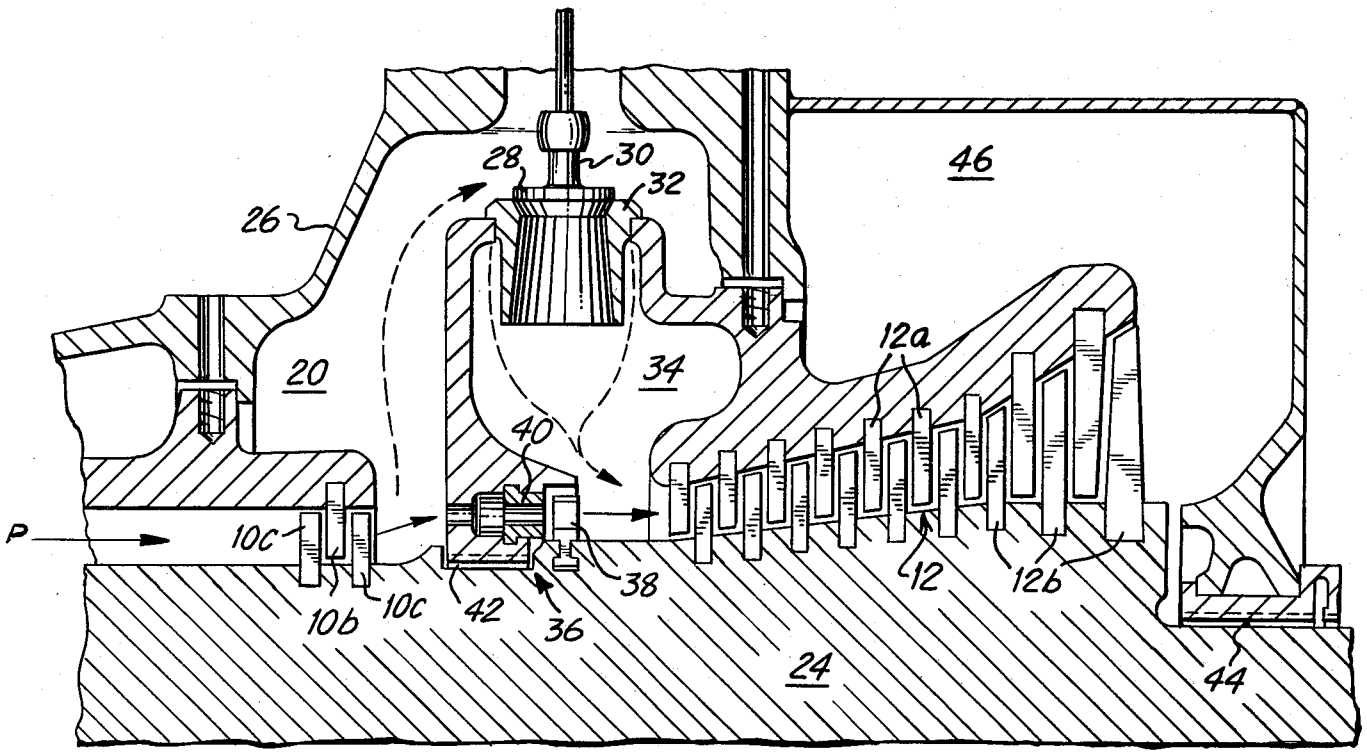
FIG. 2 is a sectional view showing in greater detail the portions of the turbine mechanism embodying the present invention.

The extraction steam section and the low pressure steam section of the turbine are depicted in greater detail in FIG. 2. As seen more clearly in FIG. 2, the turbine includes a rotor 24 and a stator housing 26 within which the extraction steam chamber 20 is defined. Steam from the high pressure section 10 of the turbine is admitted in the direction of the arrow P past the stator blades 10*b* and the rotor blades 10*c* of the high pressure section 10 from which the steam enters the steam extraction chamber 20.

The steam extraction section includes a valve mechanism 28 including a valve member 30 and a valve seat 32 defined by the stator housing 26. The valve mechanism 28 is controlled in accordance with the amount of steam which is to be extracted from the extraction chamber 20 through the steam extraction nozzles 22. When a greater amount of steam is to be extracted, the valve mechanism 28 is moved toward its closed position and as a result less steam is caused to flow from the extraction chamber 20 through the valve mechanism 28 to the low pressure section 12.

Thus, if the amount of power required to drive the low pressure section 12 is reduced, or if no power is to be utilized through the low pressure section 12, then the control valve 28 may be closed so that a maximum amount of steam may be extracted from the extraction chamber 20 for external purposes such as, for example, heating purposes.

However, when the valve 28 is closed, the blading of the low pressure section, i.e., the stator blades 12*a* and the rotor blades 12*b* thereof, will rotate but there may arise a situation where an inadequate amount of steam may be supplied to the low pressure section 12 to avoid overheating of the blades.

Of course, in order to prevent this, the valve mechanism 28 may be opened somewhat so that a certain amount of steam may flow from the extraction chamber 20 and circulate for cooling purposes through the blades of the low pressure section 12. Since this steam is of a high temperature, in order to avoid overheating, a considerable amount of steam will be necessary for this purpose and the energy of such steam may be lost from the point of view of providing useful output.

In accordance with the present invention, there is provided, in a flow path which is in parallel with the flow path through the valve mechanism 28 between the extraction chamber 20 and a wheel chamber 34 of the low pressure section 12 cooling means 36 through which steam may flow from the high pressure section through the low pressure section to avoid overheating thereof.

In accordance with the present invention, steam required for avoiding overheating of the blades of the low pressure section 12 is passed through the cooling means or cooling steam stage 36, it is cooled and then passed into the low pressure section 12. As a result of the provision of this cooling steam, a significantly smaller amount of steam will be necessary for cooling the low pressure section 12 and this will consequently increase the efficiency of the turbine.

As seen in FIG. 2, the cooling means 36 comprises rotor blade means 38, nozzle means 40 and stuffing box means 42. The stuffing box means 42 operates to seal the rotor 24 from the stator 26 at the cooling means 36. The steam flowing from the high pressure section 10 will flow through the nozzle means 40 and from there past the rotor blades 38 which operate as energy extraction means of the cooling means 36. As a result, the steam which is utilized in the cooling means 36 to cool the low pressure section 12 is also utilized to drive the rotor 24 by operation of the energy extraction rotor blade 38.

Thus, even if the amount of steam flowing through the valve mechanism 28 is inadequate to prevent overheating of the low pressure section 12, steam flowing through the cooling means 36 will be sufficient for this purpose.

As indicated in FIG. 2, the turbine of the invention also comprises a stuffing box 44 for the low pressure section, and an exhaust steam chamber 46 from which steam may be exhausted to a condenser (not shown).

Figure 3:
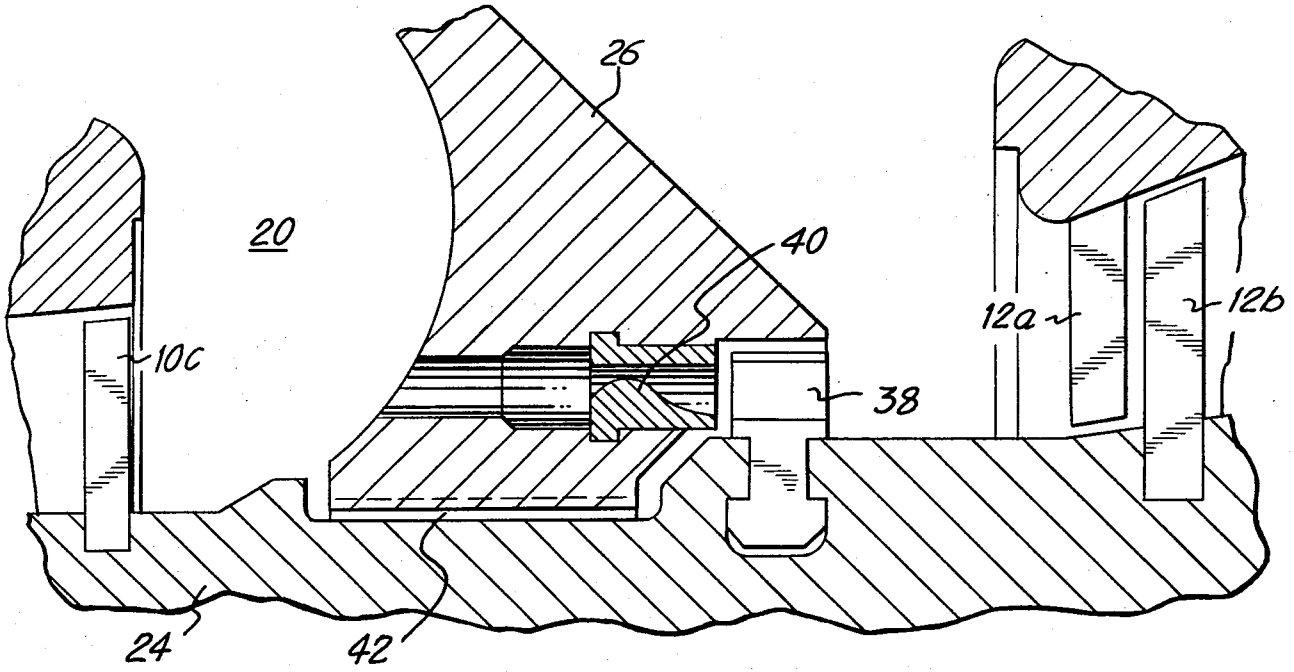
FIG. 3 is a sectional view showing in greater detail a portion of the mechanism depicted in FIG. 2.

The cooling means 36 of the invention is shown in greater detail in FIG. 3 and as indicated in FIG. 3, the nozzle means 40 of the invention may be configured to effect expansion of the steam entering the section of the rotor blades 38.

Thus, in accordance with the present invention, it will be seen that the exhaust steam temperature is reduced by removing, in the cooling steam stage 36, energy from the cooling steam which is applied to the low pressure section of the turbine. The steam expands in an orderly manner in the nozzle segment 40 which may be adjusted to prevailing pressure gradients and to the required minimum cooling steam amount. Kinetic energy generated in the nozzle is converted to mechanical energy at the blade rims of the rotor blades 38 and the temperature of the steam entering the low pressure section 12 is reduced by a gradient utilized in the cooling steam stage 36.

A significant advantage arises as a result of the present invention due to the fact that, compared with other approaches, the highest possible reduction of the low pressure cooling steam amount is achieved by means of a partial-admission cooling steam stage connected with the throttle-controlled low pressure section of the extraction condensing turbine with the intermediate stuffing box 42 when the maximum exhaust steam temperature is predetermined as a result of the structure.

A further advantage of the invention involves the fact that the amount of heat loss which must be exhausted to the condenser may be minimized. This is especially advantageous when the extraction pressure is relatively high.

Additional advantages will be derived from the invention. For example, the efficiency of the turbine will be high during operation with maximum extraction since the cooling steam generates an additional output in the cooling steam stage by virtue of the fact that the cooling steam passes over the rotor blades 38. Furthermore, a lower load is applied on the cooling steam stage as compared with that which may be applied to a control stage of a low pressure section controlled by a group of nozzles during cooling and partial load operation.

While a specific embodiment of the invention has been shown and described in detail to illustrate the application of the inventive principles, it will be understood that the invention may be embodied otherwise without departing from such principles.

What is claimed is:

1. A steam extraction turbine comprising: a high pressure turbine section; a low pressure turbine section from which steam is exhausted from said turbine; a steam extraction section arranged in the steam flow path intermediate said high and said low pressure sections of said turbine from which steam is fed into said low pressure section; said steam extraction section including steam extraction chamber means fed from said high pressure section from which steam is extracted from said turbine for external use; valve means between said steam extraction chamber means and said low pressure section for controlling the amount of steam flowing therebetween; and cooling means defining a steam flow path between said steam extraction chamber means and said low pressure section in parallel with the flow path through said valve means for supplying steam to prevent overheating of said low pressure section, said cooling means including energy extraction means for extracting from the steam flowing through said cooling means energy which is applied to drive said turbine.

2. A turbine according to claim 1 including stator means and rotor means wherein said energy extracting means comprise rotor blades of said rotor means.

3. A turbine according to claim 2 wherein said cooling means include nozzle means located in the steam flow path defined by said cooling means upstream of said rotor blades of said energy extracting means.

4. A turbine according to claim 2 including stuffing box means between said stator means and said rotor means sealing said steam extraction chamber means from said low pressure section.

5. A turbine according to claim 1 wherein said cooling means is arranged to maintain sufficient steam flow to said low pressure section to prevent overheating thereof when the quantity of steam flowing through said valve means is insufficient to prevent such overheating.

6. A turbine according to claim 1 wherein said low pressure section is utilized primarily for peak load conditions of said turbine and wherein said cooling means operates to minimize the amount of energy which is dissipated in preventing overheating of said low pressure section when use of said low pressure section is not required for driving said turbine.

* * * * *